United States Patent [19]

Ullman et al.

[11] Patent Number: 5,025,908

[45] **Date of Patent: * Jun. 25, 1991**

[54] MULTIPRICE SETTING SPLIT RING COIN CONTROL MECHANISM

[75] Inventors: Ralph J. Ullman; Alan P. Kahanek, both of Shiner, Tex.

[73] Assignee: Kaspar Wire Works, Inc., Shiner, Tex.

[ * ] Notice: The portion of the term of this patent subsequent to Apr. 10, 2007 has been disclaimed.

[21] Appl. No.: 428,205

[22] Filed: Oct. 27, 1989

Related U.S. Application Data

[63] Continuation-in-part of Ser. No. 200,076, May 27, 1988, Pat. No. 4,915,206, which is a continuation-in-part of Ser. No. 154,870, Feb. 11, 1988, Pat. No. 4,828,097.

[51] Int. Cl.[5] ..... G07F 5/08

[52] U.S. Cl. ..... 194/227

[58] Field of Search ..... 194/226, 227

[56] References Cited

U.S. PATENT DOCUMENTS 4,747,478 5/1988 Friedman et al. ..... 194/227

4,844,229 7/1989 Friedman et al. ..... 194/227 X

*Primary Examiner*—F. J. Bartuska

*Attorney, Agent, or Firm*—Gunn, Lee & Miller

[57] ABSTRACT

A coin control mechanism (52) for use with a dispensing device having an access door. The coin control mechanism includes a door locking assembly disengaged by the action of a totalizer which rotates in response to the denomination of coins dropped through a coin chute. The totalizer is connected to a price control unit comprised of three rotatable slotted rings whose slot positions may be changed to reflect different desired cumulative values of coins needed to activate the mechanism by varying the position of the slots with respect to a release bar (510) and the other slots on the split ring assembly (500). The slotted rings advance towards the release bar (510) in response to the rotation of the totalizer. When a slot engages the relase bar (510), the release latch is activated and the access door is unlatched.

17 Claims, 6 Drawing Sheets

MULTIPRICE SETTING SPLIT RING COIN CONTROL MECHANISM

This application incorporates by reference the specification and drawings of U.S. Pat. No. 4,037,701 ('701) patent, Knickerbocker 1977, and is a continuation-in-part of U.S. patent application Ser. No. 07/200,076 now U.S. Pat. No. 4,915,206 which is a continuation-in-part of U.S. patent application Ser. No. 07/154,870 (now U.S. Pat. No. 4,828,097) which also incorporates by reference the '701 patent. For sake of clarification, all the new structure added to the preceding applications begins with 600.

BACKGROUND OF THE INVENTION

1. Field of the Invention

A coin control mechanism for use in combination with a dispensing device. The mechanism includes a totalizer having at least two possible positions to allow the dispensing device to open when any one of at least two different cumulative values of coins are inserted therein.

2. Description of the Prior Art

U.S. Pat. No. 4,519,461 (Friedman et al, 1986) discloses a coin control mechanism with a totalizer means and a pair of slotted rings However, the Friedman totalizer comprises a first dog, rotatably connected to a lever, a ratchet wheel which has one tooth that is higher than others, and a stop mechanism to abut against the higher tooth to stop the ratchet wheel from rotating. These elements are structurally different from the present invention and interact in a different manner to change the dispensing (activation) position of the totalizer. In addition, the present invention incorporates fewer mechanical parts to perform similar functions, those functions being the ability to quickly change the dispenser positions of the totalizer and the activation of the coin control mechanism to allow access to the dispensing machine.

SUMMARY OF THE INVENTION

A coin control mechanism for use with a dispensing device having an access door. The coin control mechanism includes a door locking assembly disengaged by the action of a totalizer which rotates in response to the denomination of coins dropped through a coin chute, with greater rotation for coins of higher denomination. The totalizer is connected to a price control unit comprised of multiple rotatable slotted rings whose slot positions may be changed to reflect different desired cumulative values of coins needed to activate the mechanism by varying the position of the slots with respect to a release bar and the other slots on the split ring assembly.

The present invention relates to a coin control mechanism for use in combination with a periodical dispensing device having an access door including a lock operatively controlled by the coin control mechanism. More specifically, the coin control mechanism of the present invention comprises a totalizer and a coin chute arranged relative to one another such that as coins pass through the coin chute they engage the totalizer to advance the totalizer in response to the denomination of the coins. The lock of the dispensing device is released upon the totalizer reaching a dispensing or activation position registering a predetermined total cumulative value of coins inserted.

It is an object of the present invention to provide a means for quickly changing between the upper limit, middle limit, and the lower limit of coin values required to operate the coin control mechanism and allow access to the dispensing device.

It is a further object of the present invention to provide a split ring assembly by which the dispensing or activation position of the totalizer can be preset to different limits, where the number of such limit positions is determined by the number of rings on the split ring assembly.

It is a further object of the present invention to provide a means for rapidly changing the dispensing or activation positions at which the totalizer of the coin control mechanism will release the dispenser and allow access thereto.

BRIEF DESCRIPTION OF THE PREFERRED EMBODIMENT

A coin control mechanism for use with a dispensing device having an access door. The coin control mechanism includes a door locking assembly disengaged by the action of a totalizer which rotates in response to the denomination of coins dropped through a coin chute. The totalizer is connected to a price control unit comprised of multiple rotatable slotted rings whose slot positions may be changed to reflect different desired cumulative values of coins needed to activate the mechanism by varying the position of the slots with respect to a release bar and the other slots on the split ring assembly.

Figure 2:
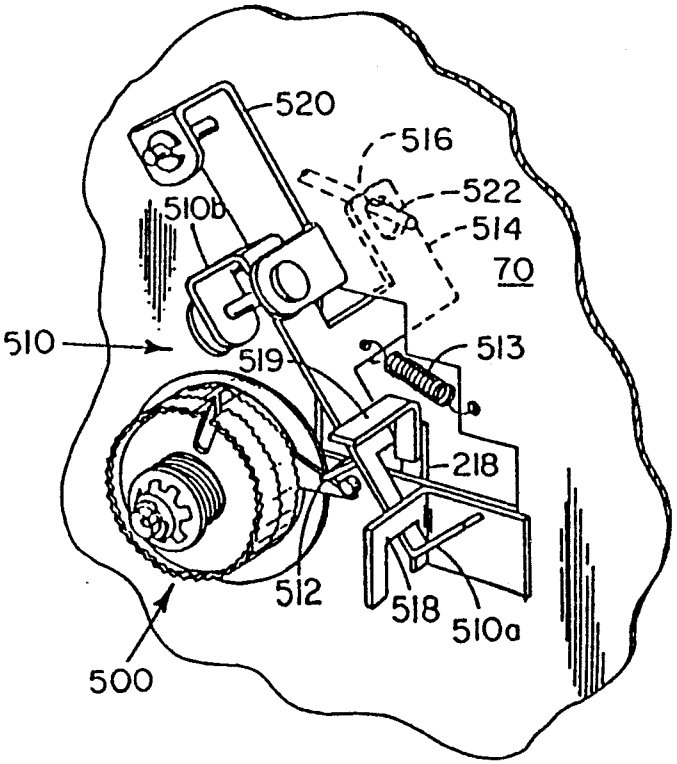
FIG. 2 is a perspective of the price control unit showing the slotted rings and the release bar.
Figure 1:
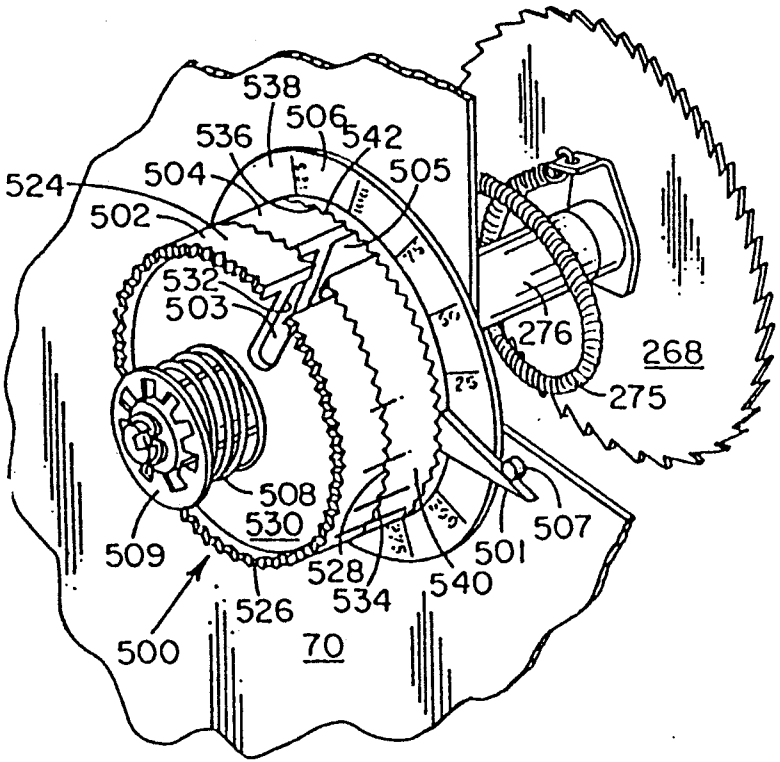
FIG. 1 is a perspective of the slotted split rings of the price control unit.

This invention replaces various components of the '701 patent with a split ring assembly (500), and release bar (510), and structure associated therewith as shown in FIGS. 1 and 2. Specifically, the structure in the '701 patent which is replaced is: wheel (272), adjustable limit means (98) and (100), limit stop (280), mounting member (278), apertures (111), and stud or pin (109).

FIG. 1 is a perspective of the slotted split rings of the price control unit apart from the coin control mechanism. As can be seen in FIG. 1, split ring assembly (500) is comprised of three main parts, top ring (502), bottom ring (504) and base plate (506). Top ring (502) contains top ring slot (503) extending through outer annulus (524), which has serrated or bitted circumferencial ridges (526) and (528) along the upper and lower perimeter thereof. Top ring (502) also has top face (530) and bottom face (532). Bottom ring (504) has bottom ring slot (505) extending through outer annulus (540), which has serrated or bitted circumferencial serrated ridges (534) and (536) along the upper and lower perimeter thereof.

Base plate (506) is generally planar and lies generally flush against coin mechanism mounting plate (70). Base plate (506) has plate stop (501) integral therewith and projecting therefrom, which contacts peg stop (507), which is mounted on mounting plate (70), when base plate (506) rotates. Base plate (506) contains an annular ring of serrated ridges (542) on top face (538) thereof. Base plate (506) is rigidly mounted to stud (276) which extends through mounting plate (70) and to which wheel (268) of the totalizer is also fixedly attached Wheel (268), base plate (506), top ring (502) and bottom ring (504) are biased in a counterclockwise direction by bias means (275) coupled to wheel (268) for rotating on stud (276). Therefore, wheel (268), base plate (506), top ring (502) and bottom ring (504) move synchronously as one and are normally biased in the counterclockwise direction.

Spring (508) and spring fastener (509) bias top ring (502) against bottom ring (504) and base plate (506). Since the bits on serrated ridges (526), (528), (534), (536) and (542) match, spring (508) will normally lock the three so split ring assembly (500) may move as a unit.

FIGS. 2 through 5 show a perspective of the price control unit showing rings (502) and (504) and release bar (510), a side view of release bar (510) in a lowered position, a side view of release bar (510) in a raised position, and a perspective view from within the coin control mechanism of release bar (510).

Release bar (510) is comprised of release bar prong (512), release bar member (514), and release bar slot (516). Release bar (510) is movable so it may be located in one of four positions, depending upon position of the key and the position of dispenser activator (218). The four positions, by location of release bar (510) with respect to plate (70) and rings (502) and (504) are: raised and open, lowered and open, raised and closed, and lowered and closed. The terms "raised" and "lowered" refer to the position of far end (510*a*) of release bar (510). The terms "open" and "closed" refer to the position of far end (510*a*) either away from or against split ring assembly (500).

Figure 3:
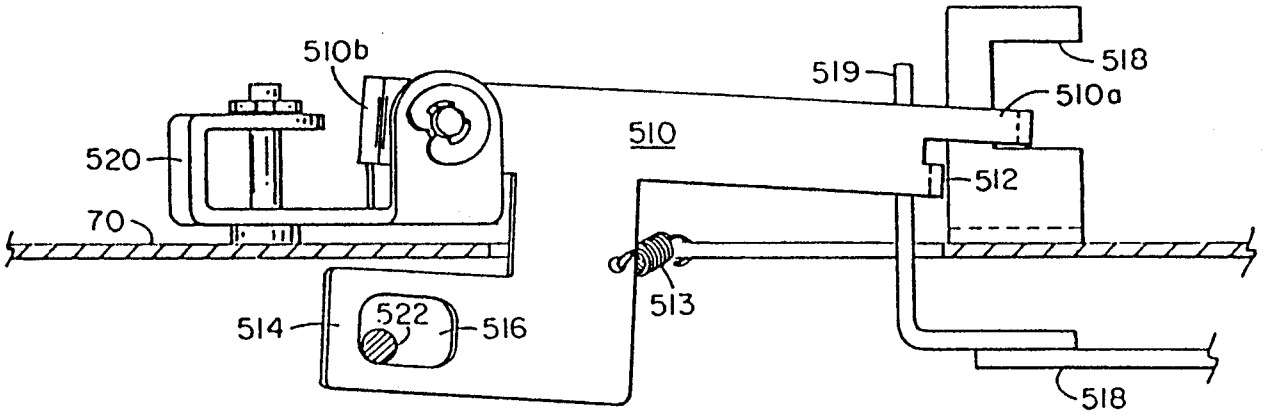
FIG. 3 is a side view of the release bar mechanism with the release bar in a lowered position.
Figure 4:
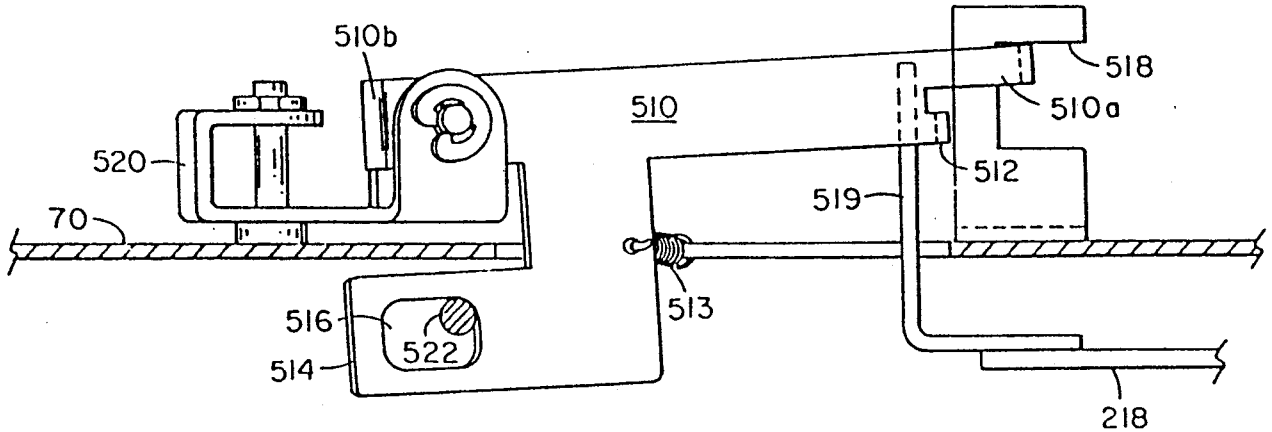
FIG. 4 is a side view of the release bar mechanism with the release bar in a raised position.
Figure 5:
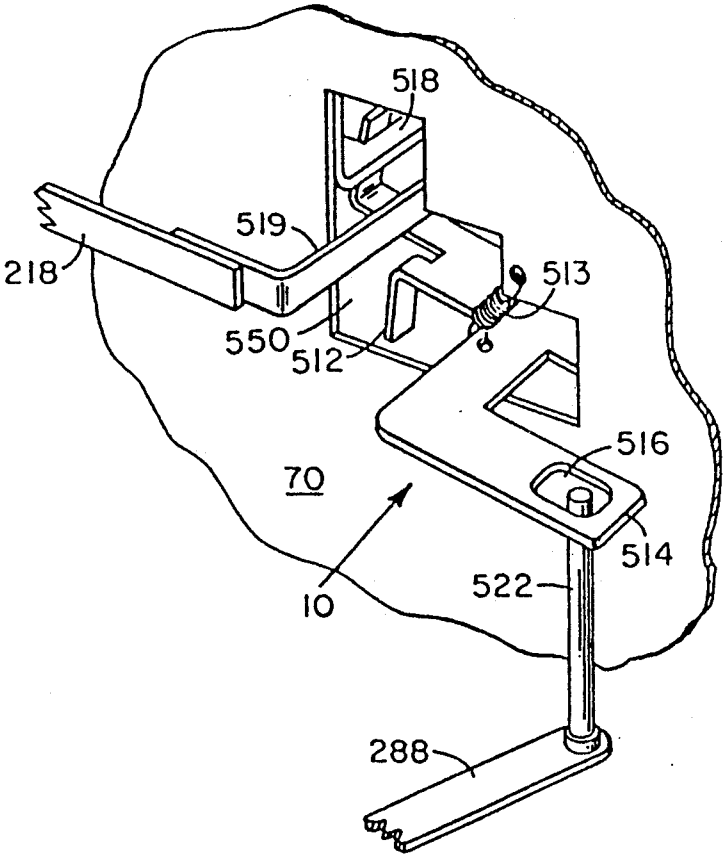
FIG. 5 is a perspective from within the coin control mechanism of the release bar mechanism.
Figure 5B:
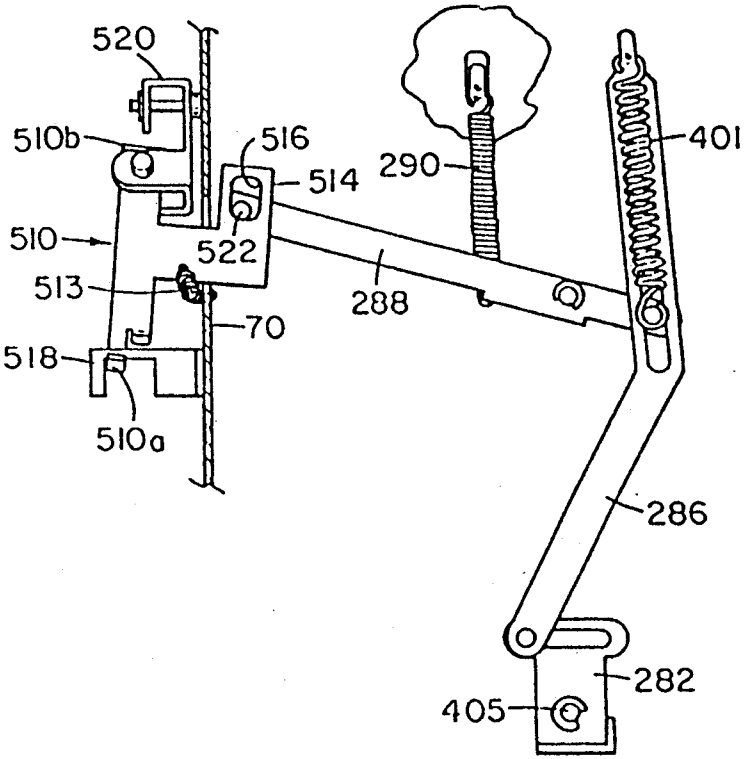
FIG. 5B is a cut away side view of the release bar mechanism illustrating the release bar in a raised position.
Figure 5A:
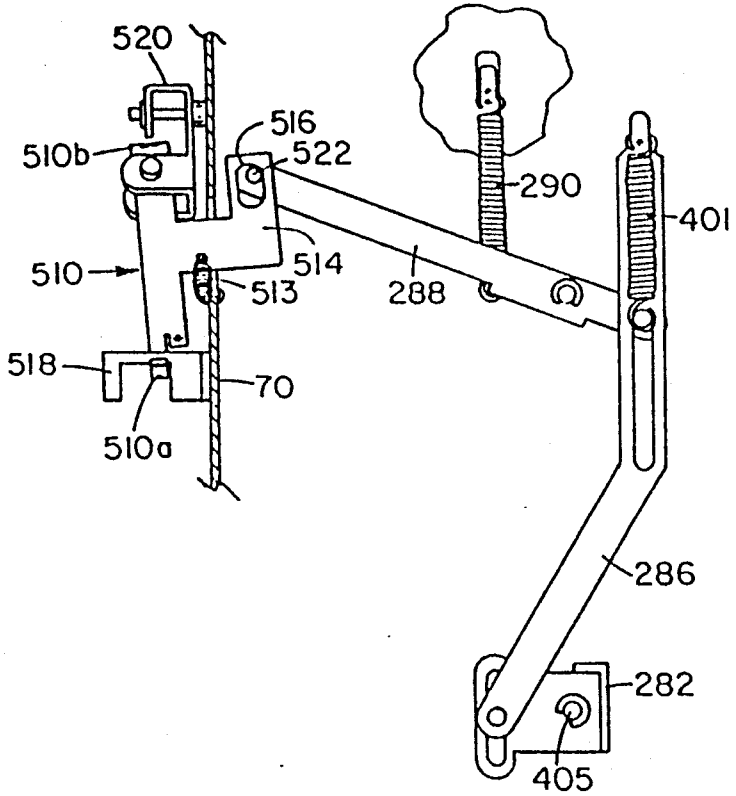
FIG. 5A is a cut away side view of the release bar mechanism illustrating the release bar in a lowered position.

The raised position can be seen illustrated in FIG. 4 and the lowered position in FIG. 3. When the release bar is closed, it is flush against split ring assembly (500); and when it is open, it is away from split ring assembly (500) and against release bar stop (518). In the manner more fully set forth below when the key is in a 0° position (arbitrarily chosen), corresponding to a lower limit of coin totals required to activate the dispenser, far end (510*a*) is in a raised position as illustrated in FIGS. 4 and 5B, and is lying generally in the plane of top ring (502). When the key is rotated to 90° far end (510*a*), moves to a lowered position as illustrated in FIGS. 3 and 5A, and is lying generally in the plane of bottom ring (504). Near end (510*b*) of release bar (510) is attached to release bar gimbal (520), and release bar (510) is free to pivot in the plane of mounting plate (70). In addition, release bar (510) can pivot vertically away from mounting plate (70) from the point where it attaches to gimbal (520).

Also illustrated in FIGS. 2 and 3 is dispenser actuator extender (519). Release bar bias spring (513) will normally bias release bar (510) against release bar stop (518) which is mounted on mounting plate (70). Extending through opening (550) (FIG. 5) in mounting plate (70) is release bar member (514) which contains release bar slot (516) therein. Release bar interconnect (522) extends perpendicular from interconnect (286) (see also FIG. 5 of the '701 patent) to engage release bar (510).

FIGS. 5A and 5B are included to illustrate the manner in which release bar (510) and the structure associated therewith engages the structure of the '701 patent. More specifically, it can be seen how linkages (282), (286) and (288), spring bias means (290), spring (501) and pin (505) are generally the same as disclosed in the parent application. However, instead of linkage (288) connecting to mounting member (278) as is disclosed in the '701 patent, linkage (288) is coupled to release bar (510) through interconnect (522).

OPERATION OF SPLIT RING ASSEMBLY

Split ring assembly (500) allows the vendor to choose between two different coin totals required to activate the dispensing machine and allow access to the merchandise contained therein. After the totals are set at an upper limit and a lower limit by rotation of the split ring assembly (500) as described more fully below, coin control mechanism (52) may be then quickly changed from the outside between the upper limit and the lower limit by rotating the key.

Split ring assembly (500) and release bar (510) allow the operator to quickly change and preset the dispensing position of the totalizer at any one of a plurality of positions These positions set an upper limit coin total and a lower limit coin total required to activate the dispensing machine.

The upper limit will reflect a larger total value of coins that will allow access to the machine than the lower limit. To set these limits, the vendor may position split ring assembly (500) so the dispensing position of the totalizer is set at an upper limit reflecting a denomination value of (for example) $1.50 and the lower limit reflecting a coin denomination value of (for example) $.25. Thereafter a quick change between these two limit positions may be made by the vendor from the outside of the machine through the use of a key.

The rotation of the key rotates interconnect member (282) and transfers that rotation through linkage (286) to linkage (288) as illustrated in FIGS. 5A and 5B. However, unlike the '701 patent in which linkage (288) actuates mounting member (278), here linkage (288) connected to release bar interconnect (522) and movement of linkage (288) is therefore translated to release bar (510).

When the key is at 0 (arbitrarily chosen) as shown in FIG. 5A, interconnect member (282) is positioned as illustrated. Linkage (286) maintains the location of linkage (288) through the bias of spring (501). In this first position, release bar member (510) is in the lower position as shown in FIG. 3 such that far end (510*a*) release bar prong (512) is aligned with bottom ring (504).

When the key is rotated 90°, interconnect member (282) is positioned as illustrated in FIG. 5B. Such rotation shifts linkage (286), actuating interconnect linkage (288), which pivots far end (510*a*) to a raised position as illustrated in FIG. 4, through the action of release bar interconnect (522). Because linkage (288) is fixedly connected to release bar interconnect (522), release bar (510) is allowed to change between the raised position (FIG. 4) and the lowered position (FIG. 3).

Dispenser actuator extender (519) is biased clockwise against release bar (510) by bias spring (234), and causes release bar prong (512) of release bar (510) to press against split ring assembly (500) when the coin control mechanism (52) is in a locked, non-dispensing position.

The preset non-dispensing position of the totalizer is fixed by the position of plate stop (501) as it rests against peg stop (507). As coins are placed into the coin chute and activate the totalizer, the totalizer begins advancing towards the dispensing position. Split ring assembly (500) advances along with the totalizer. As this occurs, both top ring slot (503) and bottom ring slot (505) approach release bar prong (512). If the key is in the first position (0°), release bar (510) will be in a lower position (FIGS. 3 and 5A) and release bar prong (512) will ultimately engage bottom ring slot (505). On the other hand, if the key is in the second position (90°), release bar (510) will be in a raised position (FIGS. 4 and 5B), and release bar prong (512) will ultimately engage top ring slot (503). In either case, when release bar prong (512) enters a slot (503 or 505), dispenser actuator (218) will release locking mechanism, allowing access to the dispenser.

Two different dispensing positions, representing upper and lower coin value totals, may be set by the vendor by raising top ring (502) and/or bottom ring (504) away from base plate (506) and repositioning slots (503) and (505) with respect to base plate (506) while allowing plate stop (501) to rest against peg stop (507) (the non-dispensing position of totalizer). Base plate (506) is preferably marked with denominations (see FIG. 1) illustrating the positions over which either slot (403 or 505) may be set. For example, bottom ring slot (505) may be set over the "50" position which represents coins totalling $.50. At the same time, the operator may raise top ring (502) and twist it so top ring slot (503) is above the "100" mark on base plate (506). The operator has thereby quickly and easily set lower limit of totalizer at $.50 and an upper limit of totalizer at $1.00 for coin control mechanism (52).

ANOTHER PREFERRED EMBODIMENT

Figure 6:
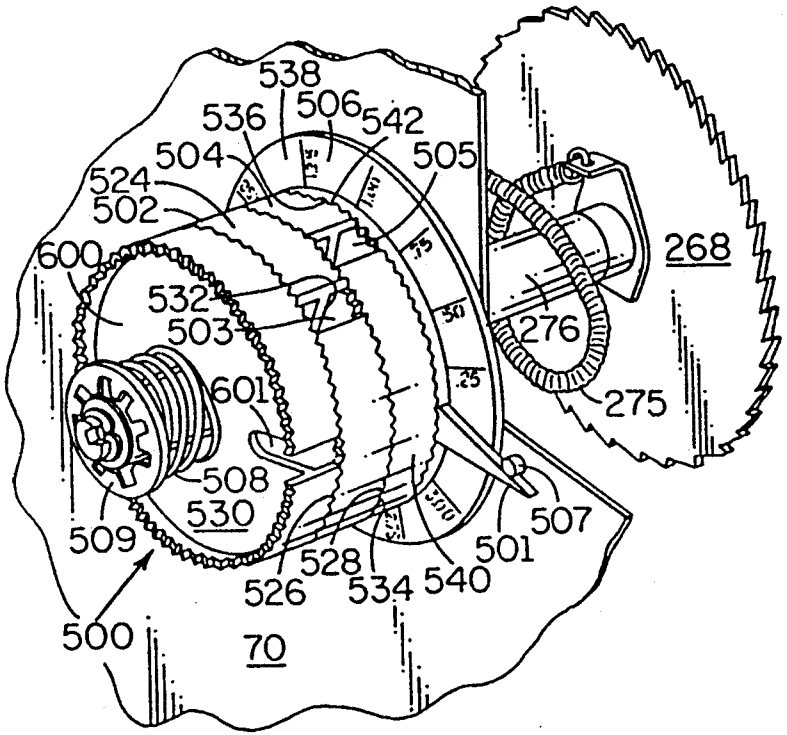
FIG. 6 is a perspective view of the coin control mechanism with three slotted rings.
Figure 7:
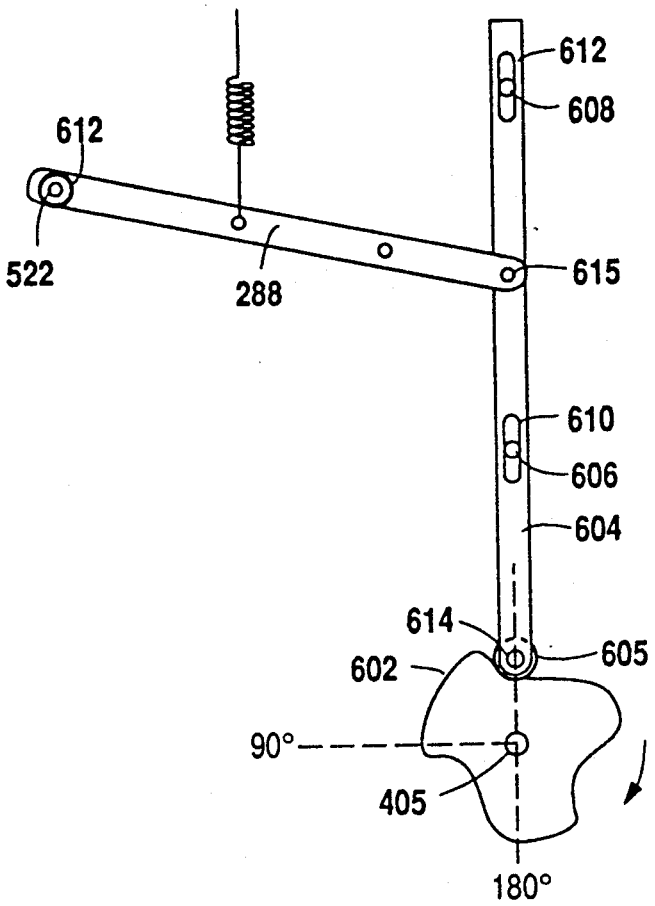
FIG. 7 is an elevational view of the coin control mechanism showing the cam and linkage.
Figure 8:
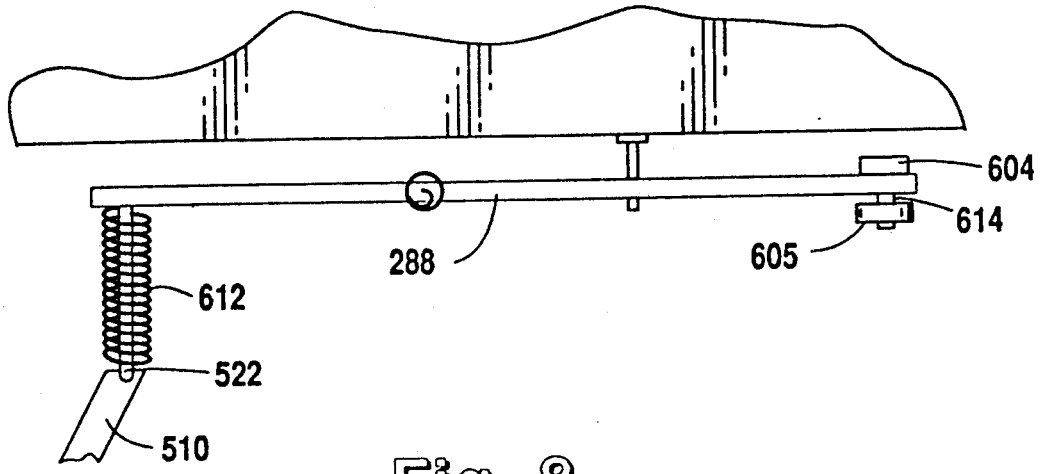
FIG. 8 is an elevational view of the coin control mechanism showing the cam and linkage.

FIGS. 6, 7, and 8 illustrate yet another preferred embodiment of the invention. This embodiment contains a third ring (600) with slot (601) therein. Third ring (600) is dimensionally and functionally similar to rings (502) and (504). Third ring (600) contains a bitted annulus on the bottom surface thereof to interlock with ring (502) in the same manner as rings (502) and (504) interlock. Spring (508) and spring fastener (509) bias the three rings against base plate (506) in the same manner as illustrated in FIGS. 1 and 2 and set forth above. Ring slot (601) is positioned angularly about base plate (506) to reflect a third preselected dispensing position of the totalizer means, in the same manner that slots (503) and (505) are positioned to reflect two other alternate dispensing positions of the totalizer means. In such a manner, the addition of a third ring, as illustrated, allows the vendor to select any one of three possible coin combinations.

Release bar (510) functions in the same manner as described for the two-ring embodiment set forth above. That is, release bar (510) is urged against one of the three rings as the totalizer advances from a nondispensing position to a dispensing position as coins are inserted into the coin mechanism. The use of the third ring (600) allows the vendor the choice of preselecting any one of three different prices.

FIGS. 7 and 8 show the use of cam (602) and roller (605) in place of linkage (282) and (286) as illustrated in FIGS. 5A and 5B. That is, cam (600) may be locate release bar (510) at any one of three positions, which positions reflect the positions of slots (501), (505), and (601). Cam (602) is rotated by a key means (not shown) to one of three positions: 0°; 90°; or 180°. Such rotation will slide actuation arm (604), pivot linkage (288) at pivot point (615), swing interconnect (522) and thus position release bar (510) at the desired ring, such desired ring corresponding to the vendor's choice of one of three prices. Guide pins (606) and (608) ride in guide slots (610) and (612) to insure linear motion of actuation arm (604).

Spring (612) (see FIG. 8) located near the distal end of linkage (288) biases release bar (510) against release bar stop (518), as an alternative to bias spring (513) biasing release bar (510) against release bar stop (518), as is illustrated in FIGS. 2 and 3.

Use of cam (602), roller (605), and roller stud (614), in conjunction with rotation means, allows for a smoother and more durable mechanism to transmit the angular rotation of the key means to movement of release bar (510) then has heretofore been recognized.

Figure 9:
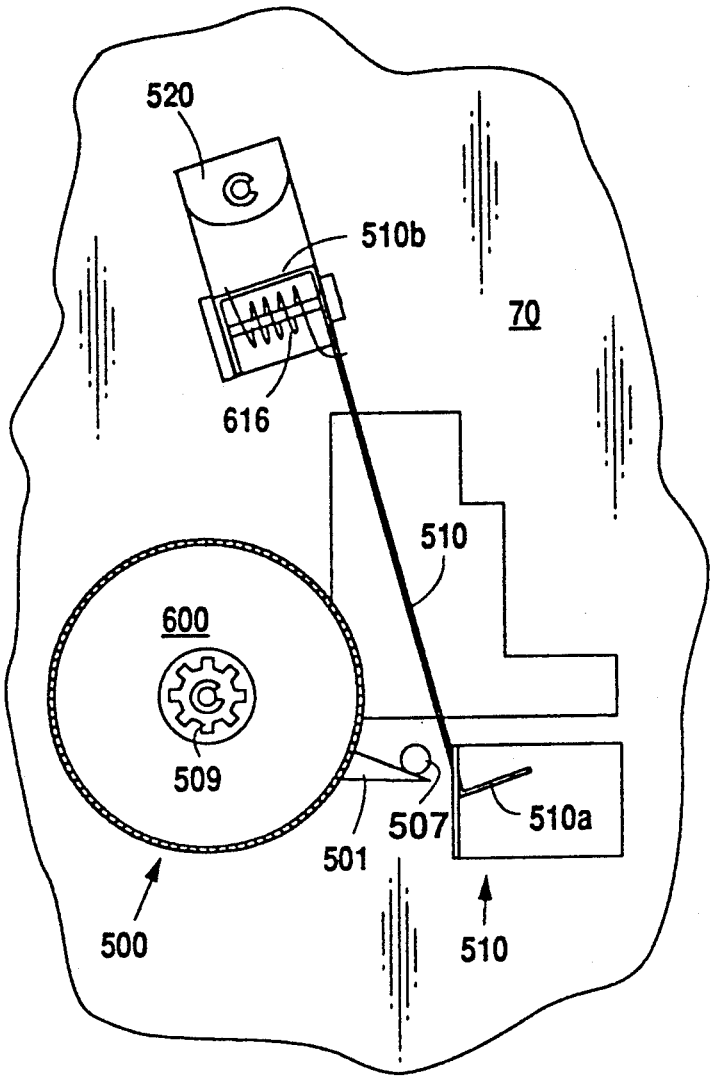
FIG. 9 illustrates an elevational view of a portion of the release bar and the totalizer mechanism.

FIG. 9 illustrates bias means (616) located at near end (510*b*) of release bar (510) to bias the release bar down and adjacent to bottom ring (504).

Terms such as "left," "right," "up," "down," "bottom," "top," "front," "back," "in," "out," "clockwise," "counterclockwise" and the like are applicable to the embodiment shown and described in conjunction with the drawings. These terms are merely for the purposes of description and do not necessarily apply to the position in which the device may be constructed or used.

Although the invention has been described with reference to a specific embodiment, this description is not meant to be construed in a limiting sense. Various modifications of the disclosed embodiments will become apparent to those skilled in the art upon reference to the description of the invention. It is therefore contemplated that the appended claims will cover such modifications that fall within the true scope of the invention.

I claim:

1. A coin mechanism device for use with a dispersing machine accessible from the outside for quickly changing the value of coins required to activate the coin mechanism between resetable high, middle, and low values of coins, the coin mechanism having a totalizer that advance from a non-dispensing position to a dispensing position as coins are inserted into the coin mechanism, the device comprising:

rotation means rotatable among a first angular position, a second angular position, and a third angular position, said rotation means being accessible from the outside of said coin mechanism.

a price control unit comprised of a first ring, a second ring, a third ring, and a release bar in operative association with said rotation means, said rings rotatably mounted to said totalizer and advancing therewith from the non-dispensing position of the dispensing position as coins are inserted into the coin mechanism;

said release bar having a first end and a second end, said first end being fixed and said second end being movable for positioning against said first ring when said rotation means is in the first angular position, and against said second ring when said rotation means is in the second angular position, and against said third ring when said rotation means is in the third angular position wherein said release bar of said price control unit further comprises a release bar bracket, said release bar bracket attached to a housing of the coin mechanism device and to said first end of said release bar for allowing said release bar to pivot in a plane perpendicular to the plane of said totalizer and also pivot in a plane parallel to the plane of said totalizer;

said first ring having a first ring slot therein, the position of the first ring slot being changeable with respect to said release bar by rotating said first ring, the position of said first ring slot determining a lower limit of the totalizer;

said second ring having a second ring slot therein, the position of the second ring slot being changeable with respect to said release bar by rotating said second ring, the position of said second ring slot determining a middle limit of the totalizer;

said third ring having a third ring slot therein, the position of the third ring slot being changeable with respect to said release bar by rotating said third ring, the position of said third ring slot determining an upper limit of the totalizer;

wherein said totalizer causes said first ring, said second ring, and said third ring to rotate from a non-dispensing position to a dispensing position in response to the insertion of coins into said coin mechanism, said release bar is urged against said first ring when said rotation means is rotated to said first angular position, said second ring when said rotation means is rotated to said second angular position, or said third ring when said rotation means is rotated to said third angular position, said release bar engaging the desired ring slot when the desired ring slot reaches the dispensing position and the engagement releases means which allow access to the dispensing machine.

2. The coin mechanism device as described in claim 1 wherein said price control unit further comprises a base plate fixedly attached to said totalizer and rotatable therewith and a stop means integral with said base plate, said stop means for locating the non-dispensing position of the totalizer.

3. The coin mechanism device as described in claim 2 wherein said stop means includes a tooth projecting from said base plate and a peg attached to a housing of the coin mechanism device, said peg located to intercept said tooth when said totalizer and said base plate are biased towards said peg, said peg position thereby locating the non-dispensing position of said totalizer.

4. The coin mechanism device as described in claim 2 further including a coupling means in operative association with said base plate, said first ring, said second ring, and said third ring so that as coins are inserted into the coin mechanism device, said totalizer, said base plate, said first ring, said second ring and said third ring move simultaneously from the non-dispensing position to the dispensing position.

5. The coin mechanism device as described in claim 4 wherein said coupling means further comprises a first bitted set, a second bitted set, a third bitted set and a bias means; the first bitted set comprising a first bitted annulus on the top surface of said base plate and a matching second bitted annulus in opposed relation on the bottom surface of said first ring, the second bitted set comprising a third bitted annulus on the top surface of said first ring and a matching fourth bitted annulus in opposed relation on the bottom surface of said second ring; the third bitted set comprising a fifth bitted annulus on the top surface of said second ring and a matching sixth bitted annulus in opposed relation on the bottom surface of said third ring; wherein said bias means locks the bitted sets together and allows said base plate, said first ring, said second ring and said third ring to rotate as a unit simultaneous with the rotation of said totalizer.

6. The coin mechanism device as described in claim 5 wherein the planes of said base plate, said first ring, said second ring and said third ring are generally parallel, and perpendicular to the axis of rotation of said base plate, said first ring, said second ring, said third ring and said totalizer.

7. The coin mechanism device as described in claim 1 wherein said price control unit further comprises release bar stop means and bias means, the bias means for urging the release bar against stop means when the access means is released.

8. The coin mechanism device as described in claim 1 further comprising a release bar bias means for urging said release bar against the desired ring while said access means prevents access to the dispensing machine and for retracting release bar from said slot of the desired ring following engagement of said release bar with said slot of the desired ring and access to the dispensing machine.

9. A coin control mechanism for use with a dispensing machine having latch means, the coin control mechanism comprising:

a housing;

coin chute means for receiving the coins therein;

activator means movably attached to said housing to lockingly engage the latch means;

totalizer means movable between a non-dispensing position and a dispensing position disposed relative to said coin chute to advance from the non-dispersing position to the dispensing position in response to coins fed through said coin chute means;

multiprice setting means for setting the non-dispensing position of the totalizer means and for quickly changing the dispensing position of the totalizer means between an upper, a middle and a lower limit, wherein said multiprice setting means comprises a first ring with a first slot therein, a second ring with a second slot therein and a third ring with a third slot therein and a release bar, which, when located in a first position is movable against the first ring, when located in a second position is movable against the second ring, when located in a third position is movable against the third ring, and when located in a retracted position is away from the rings, wherein the plane of said first ring, the plane of said second ring, the plane of said third ring and all plane of said totalizer means are generally parallel, said multiprice setting means further including a release bar bracket, and wherein said release bar contains a first end and a second end, the first end connected to said release bar bracket and capable of allowing said release bar to move in a plane perpendicular to the plane of said totalizer means and also in a plane parallel to the plane of said totalizer means;

adjustable price setter means in operative association with said multiprice setter means for selecting the dispensing position of the totalizer means from among the upper limit, the middle limit and the lower limit by selectively locating the release bar at the first position, the second position, or the third position.

means coupled to said adjustable price setter means to select said adjustable price setter means from among a first angular position, a second angular position and a third angular position;

wherein said coupling means when locating said adjustable price setter means at the first angular position thereby locates said release bar in the first position, movable against the first ring, for engagement therewith, when locating said adjustable price setter means at the second angular position thereby locates said release bar in the second position, movable against the second ring for engagement therewith, and when locating said adjustable price setter means at the third angular position thereby locates said release bar in the third position, movable against the third ring for engagement therewith, said totalizer means for advancing from the non-dispensing position to the dispensing position in response to coins inserted into the coin chute means, said release bar, being urged against the desired ring, for engagement with the desired slot, such engagement causing said activator means to disengage the latch means and thereby allow access to the dispensing machine.

10. The coin mechanism device as described in claim 9 wherein said multiprice setting means further includes a base plate with a tooth, the tooth being integral with said base plate and projecting therefrom and a peg stop, the peg stop being fixedly mounted on said housing to engage said base plate, said totalizer means being located at the nondispensing position when the tooth of said base plate is contacting the peg.

11. The coin mechanism device as described in claim 10 further including an interlock set means in operative association with said multiprice setting means to permit said first ring, said second ring, said third ring and said base plate to move synchronously with one another and with said totalizer means as said totalizer means advances from the non-dispensing position to the dispensing position in response to coins inserted into said coin chute means.

12. The coin mechanism as described in claim 11 wherein said interlock set means further comprises a spring with a spring detain means, a first ring lock means, a second ring lock means and a third ring lock means, wherein the spring urges said third ring against said second ring, said second ring against said first ring and said first ring against said base plate, the urging causing engagement of said third ring lock means to fix the angular slot position of said third ring with respect to said second ring, said second ring lock means to fix the angular slot position of said second ring with respect to said first ring and also causing engagement of said first ring lock means to fix the angular slot position of said first ring with respect to said base plate, the angular slot position of said rings determining the dispensing position of said totalizer means and capable to being changed by disengaging the desired ring lock means and rotating the desired ring until the ring slot is in the desired position, such desired position determining the dispensing position of said totalizer means.

13. The coin mechanism as described in claim 9 wherein said multiprice setting means further includes a base plate with a tooth, the tooth being integral with said base plate and projecting therefrom and a peg stop, the peg stop being fixedly mounted on said housing to engage said base plate, said totalizer means being located at the non-dispensing position when the tooth of said base plate is contacting the peg; and further including an interlock set means in operative association with said multiprice setting means to permit said first ring, said second ring, said third ring and said base plate to move synchronously with one another and with said totalizer means as said totalizer means advances from the non-dispensing position to the dispensing position in response to coins inserted into said coin chute means.

14. The coin mechanism as described in claim 13 wherein the interlock set means further comprises a spring with a spring detain means, a first ring lock means, a second ring lock means and a third ring lock means, wherein the spring urges said third ring against said second ring, said second ring against said first ring and said first ring against said base plate, the urging causing engagement of said third ring lock means to fix the angular slot position of said third ring with respect to said second ring, said second ring lock means to fix the angular slot position of said second ring with respect to said first ring and also causing engagement of said first ring lock means to fix the angular slot position of said first ring with respect to said base plate, the angular slot position of said rings determining the dispensing position of said totalizer means and capable to being changed by disengaging the desired ring lock means and rotating the desired ring until the ring slot is in the desired position, such desired position determining the dispensing position of said totalizer means.

15. The coin mechanism as described in claim 9 herein said multiprice setting means further includes a release bar bracket, and wherein said release bar contains a first end and a second end, the first end connected to said release bar bracket and capable of allowing said release bar to move in a plane perpendicular to the plane of said totalizer means and also in a plane parallel to the plane of said totalizer means; and wherein said multiprice setting means further includes a base plate with a tooth, the tooth being integral with said base plate and projecting therefrom and a peg stop, the peg stop being fixedly mounted on said housing to engage said plate, said totalizer means being located at the non-dispensing position when the tooth of said base plate is contacting the peg.

16. The coin mechanism as described in claim 15 further including an interlock set means in operative association with said multiprice setting means to permit said first ring, said second ring, said third ring and said base plate to move synchronously with one another and with said totalizer means as said totalizer means advances from the non-dispensing position to the dispensing position in response to coins inserted into said coin chute means.

17. A coin mechanism device for use with a dispensing machine accessible from the outside for quickly changing the value of coins required to activate the coin mechanism between resetable high and low values of coins, the coin mechanism having a totalizer that advances from a non-dispensing position to a dispensing position as coins are inserted into the coin mechanism, the device comprising:

rotation means rotatable between a first angular position, a second angular position, and a third angular position, said rotation means being accessible from the outside of said coin mechanism;

a price control unit comprised of a first ring, a second ring, a third ring, a base plate, a coupling means, a release bar, a release bar bracket, a release bar stop means and a release bar bias means, said first ring, said second ring, said third ring and said base plates rotatable mounted to the totalizer and advancing therewith from the non-dispensing position to the dispensing position as coins are inserted into the coin mechanism, wherein the planes of said first ring, said second ring, said third ring, said base plate and the totalizer are generally parallel and perpendicular to the axis of rotation of said first ring, said second ring, said third ring, said base plate and the totalizer;

said release bar having a first end and a second end, the first end being attached to said release bar bracket, which is in turn attached to a housing of the coin mechanism device, the second end of said release bar being free, the attachment of the first end for allowing said release bar to pivot therefrom in a plane perpendicular to the plane of said totalizer and also in a plane parallel to the totalizer;

said base plate, fixedly attached to the totalizer and rotatable therewith, further including a tooth projecting from said base plate for intercepting a peg attached to the housing of the coin mechanism and thereby locating the non-dispensing position of the totalizer;

said first ring having a first ring slot therein, the position of the first ring slot changeable with respect to the position of said release bar by rotating said first ring, the position of said first ring slot determining a lower limit of the totalizer;

said second ring having a second ring slot therein, the position of the second ring slot changeable with respect to the position of said release bar by rotating said second ring, the position of said second ring slot determining an upper limit of the totalizer;

said third ring having a third ring slot therein, the position of the third ring slot changeable with respect to the position of said release bar by rotating said third ring, the position of said third ring slot determining an middle limit of the totalizer;

said coupling means comprising a first bitted set, a second bitted set, a third bitted set and a bias means; the first bitted set comprising a first bitted annulus on said base plate and a matching interlockable second bitted annulus in opposed relation on the bottom surface of said first ring, the second bitted set comprised of a third bitted annulus on the top surface of said first ring and a matching interlockable fourth bitted annulus in opposed relation on the bottom surface of said second ring, the third bitted set comprising a fifth bitted annulus on the top surface of the second ring and a matching, interlockable sixth bitted annulus in opposed relation on the bottom surface of said third ring; wherein said bias means locks the bitted sets together and allows said base plate, said first ring, said second ring and said third ring to rotate as a group simultaneously with the rotation of the totalizer, wherein the vendor may change the position of the desired ring slot by unlocking the appropriate bitted set and rotating the desired ring such that the desired ring slot is in the desired position, such position representing the dispensing position;

wherein the totalizer causes said first ring, said second ring, and said third ring to rotate from a non-dispensing position to a dispensing position in response to the insertion of coins into said coin mechanism, said release bar is urged against said first ring when said rotation means is rotated to said first angular position, said second ring when said rotation means is rotated to said second angular position, or said third ring when said rotation means is rotated to said third angular position, wherein said release bar engages the desired ring slot when the desired ring slot reaches the dispensing position and the engagement releases means which allow access to the dispensing machine.

* * * * *